US006226832B1

(12) United States Patent
McCormick

(10) Patent No.: US 6,226,832 B1
(45) Date of Patent: May 8, 2001

(54) EASY MAINTENANCE VACUUM CLEANER

(75) Inventor: Michael J. McCormick, Danville, KY (US)

(73) Assignee: Matsushita Home Appliance Corporation of America, Danville, KY (US)

( * ) Notice: Subject to any disclaimer, the term of this patent is extended or adjusted under 35 U.S.C. 154(b) by 0 days.

(21) Appl. No.: 09/297,692

(22) PCT Filed: Apr. 23, 1998

(86) PCT No.: PCT/US98/08200

§ 371 Date: May 5, 1999

§ 102(e) Date: May 5, 1999

(87) PCT Pub. No.: WO99/53820

PCT Pub. Date: Oct. 28, 1999

(51) Int. Cl.[7] ..... A47L 9/04
(52) U.S. Cl. ..... 15/391; 15/389
(58) Field of Search ..... 15/352, 363, 364, 15/383, 389, 391, 412

(56) References Cited

U.S. PATENT DOCUMENTS

| | | | | |
|---|---|---|---|---|
| 1,829,582 | | 10/1931 | Carson . | |
| 2,040,188 | | 5/1936 | Smellie . | |
| 2,139,146 | | 12/1938 | Becker . | |
| 2,253,997 | | 8/1941 | Becker . | |
| 2,618,007 | | 11/1952 | Fuller . | |
| 2,910,721 | | 11/1959 | Burrage . | |
| 3,148,400 | | 9/1964 | Worwag . | |
| 3,460,188 | * | 8/1969 | Boyd | 15/383 |
| 3,482,276 | | 12/1969 | Fillery . | |
| 3,786,532 | * | 1/1974 | Lindsay | 15/364 |
| 3,916,476 | * | 11/1975 | Johnson et al. | 15/391 |
| 4,171,554 | | 10/1979 | Tschudy . | |
| 4,512,057 | | 4/1985 | Laing et al. . | |
| 4,724,574 | | 2/1988 | Bowerman et al. . | |
| 4,980,945 | | 1/1991 | Bewley . | |
| 5,029,361 | | 7/1991 | Murata et al. . | |
| 5,054,156 | | 10/1991 | Watanabe et al. . | |
| 5,093,956 | | 3/1992 | Saunders et al. . | |
| 5,129,128 | | 7/1992 | Bowerman et al. . | |
| 5,309,601 | | 5/1994 | Hampton et al. . | |
| 5,414,893 | | 5/1995 | Hampton et al. . | |
| 5,500,979 | * | 3/1996 | Worwag | 15/352 |
| 5,537,710 | * | 7/1996 | Selewski et al. | 15/391 |
| 5,551,122 | | 9/1996 | Burkhardt et al. . | |
| 5,632,060 | * | 5/1997 | Steinberg et al. | 15/391 |
| 5,671,499 | | 9/1997 | Melito et al. . | |

* cited by examiner

*Primary Examiner*—Terrence R. Till
(74) *Attorney, Agent, or Firm*—King & Schickli

(57) ABSTRACT

A vacuum cleaner includes a housing having a nozzle assembly and a handle. An agitator shield is held in the nozzle assembly. An agitator is mounted for rotation relative to the nozzle assembly in an agitator chamber. A fan and motor assembly mounted to the housing drive the agitator and provide suction.

10 Claims, 4 Drawing Sheets

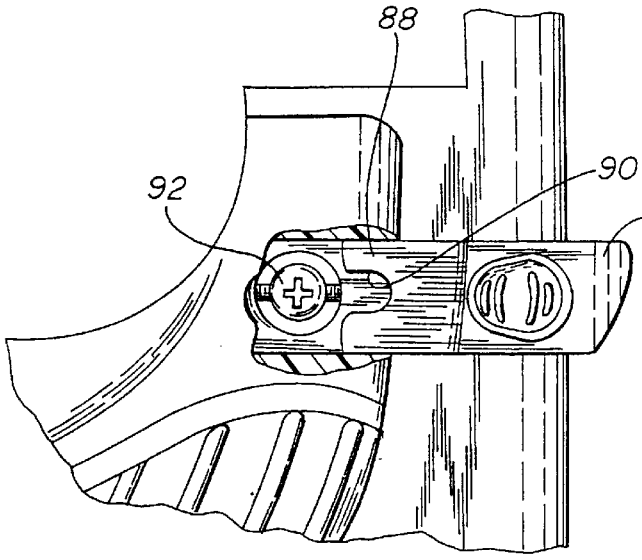
Fig. 5a
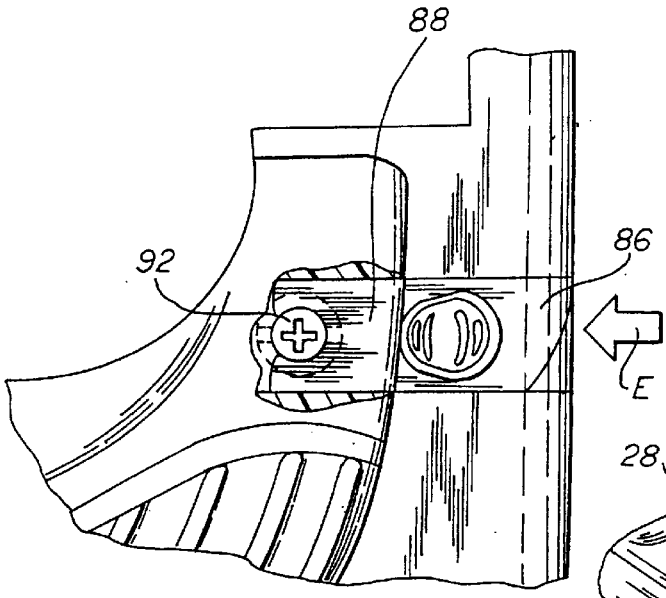
Fig. 5b
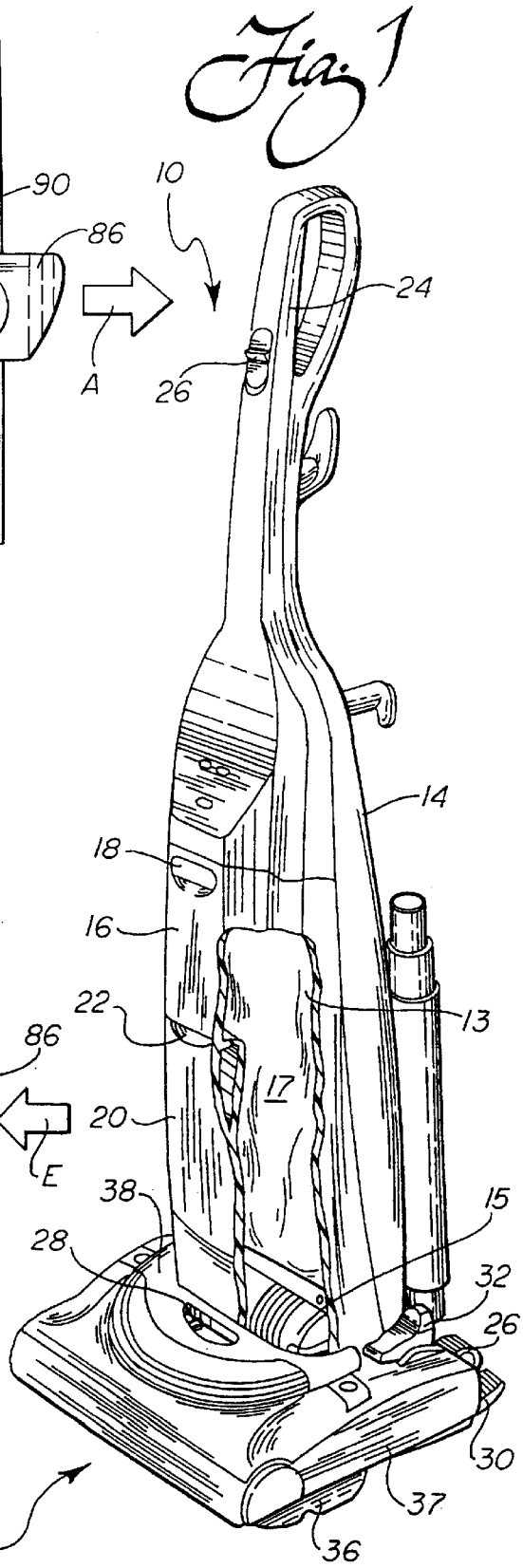

EASY MAINTENANCE VACUUM CLEANER

This is a 371 National Phase of application No. PCT/US98/08200, filed Apr. 23, 1998.

TECHNICAL FIELD

The present invention relates generally to the floor care field and, more particularly, to an upright vacuum cleaner of unique construction allowing maintenance of the headlight, agitator and the agitator drive belt without having to invert or otherwise reorient the vacuum cleaner from its normal storage position.

BACKGROUND OF THE INVENTION

A vacuum cleaner is an electrically powered, mechanical appliance utilized for the dry removal of dust and loose dirt from carpets, rugs, fabrics and other surfaces. Vacuum cleaners have been widely utilized for years in domestic and industrial cleaning applications. In operation, a pressure drop is utilized to force air entrained with the dust and loose dirt into the nozzle of the vacuum cleaner. The dirt and dust laden air is then drawn through a bag which traps and retains the dust and dirt. The air is then exhausted by electric fan through an additional filter to remove relatively fine particles. It is this fan that provides the air pressure drop or vacuum that produces the cleaning action.

The present invention relates to an upright type of vacuum cleaner which allows easy in home service of the headlight, agitator and agitator belt while the vacuum cleaner is maintained in the right side up orientation. This is a significant convenience feature since it eliminates the need to lift and manipulate the vacuum cleaner to complete this maintenance service.

SUMMARY OF THE INVENTION

It is a primary object of the present invention to provide an upright vacuum cleaner of unique construction that is simple and economical to manufacture.

Yet another object of the present invention is to provide an upright vacuum cleaner providing dependable service and ease of maintenance.

Still another object of the present invention is to provide an upright vacuum cleaner allowing service of the headlight, agitator and agitator drive belt by the simple removal of one or more covers while the vacuum cleaner is maintained in its normal storage position without the need to invert the vacuum cleaner. In this way, manipulation and lifting of the vacuum cleaner is avoided and standard maintenance is simplified and made far more convenient for the satisfaction of the user.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved vacuum cleaner is provided. That improved vacuum cleaner includes a housing having a nozzle assembly and a handle. The vacuum cleaner also includes an inner agitator shield that is held in the nozzle assembly. That inner agitator shield functions with the nozzle assembly to define an agitator chamber. An agitator is mounted for rotation relative to the nozzle assembly in the agitator chamber. Further, a motor and fan assembly are mounted to the housing for driving the agitator and providing suction.

More specifically describing the invention, the nozzle assembly includes a base and removable upper cover. The upper cover preferably includes at least one slide latch while the base includes at least one cooperating mounting boss. When the cover is positioned and locked in position on the base the slide latch engages the mounting boss.

The inner agitator shield preferably includes an elongated, substantially arcuate body and a releasable latch allowing the inner agitator shield to be selectively removed from the nozzle assembly and, more specifically, the base. Preferably, the inner agitator shield includes at least one projecting lug and the base includes at least one cooperating lug engaging shoulder. Further, the releasable latch includes at least one resilient locking clip projecting in a direction substantially opposite from the projecting lug. The base also includes a cooperating lip for engaging the locking clip. Accordingly, the agitator shield is held securely in position on the base of the nozzle assembly by engagement of the lug with the shoulder on one side and at least one resilient locking clip with the cooperating lip on the other side.

Additionally, it should be appreciated that the base includes a pair of opposed mounting channels. Each of the mounting channels is closed at one end and opens upwardly at a second, opposite end toward the removable upper cover. The agitator includes a pair of end caps. One end cap is provided at each end of the agitator. Each end cap also includes a mounting lug. Each mounting lug is received in one of the mounting channels when the agitator is carried in and mounted for rotation relative to the base.

Further describing the invention, the inner agitator shield is preferably molded from a single piece of resilient plastic. Additionally, the vacuum cleaner preferably includes a headlight mounted to the inner agitator shield adjacent a window provided in the releasable cover. Preferably, the inner agitator shield is molded from white plastic so as to act as a secondary light reflector that directs the light through the window in order to provide better illumination for vacuuming shadowy areas.

Advantageously, the structural arrangement of the vacuum cleaner of the present invention allows one to change the headlight, the agitator and/or the agitator drive belt by the opening of one or more latches and the simple removal of various parts. As an extra benefit and convenience, the disassembly and the maintenance service may be performed without inverting, tilting or otherwise manipulating the vacuum cleaner from the upright storage position. Thus, it should be appreciated that the present invention also embodies a method of changing an agitator drive belt in a vacuum cleaner. This method includes the step of removing the removable cover from the base so as to expose the agitator shield. The method also includes the removing of the agitator shield so as to expose the agitator. This is then followed by the step of removing the agitator and changing the agitator drive belt all while maintaining the vacuum cleaner in the right side up orientation.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing:

FIG. 1 is a perspective view of a vacuum cleaner constructed in accordance with the teachings of the present invention;

FIGS. 5*a* and 5*b* are detailed top plan views showing the slide latch and cooperating boss that are utilized to secure the releasable cover to the base of the nozzle assembly;

Figure 2:
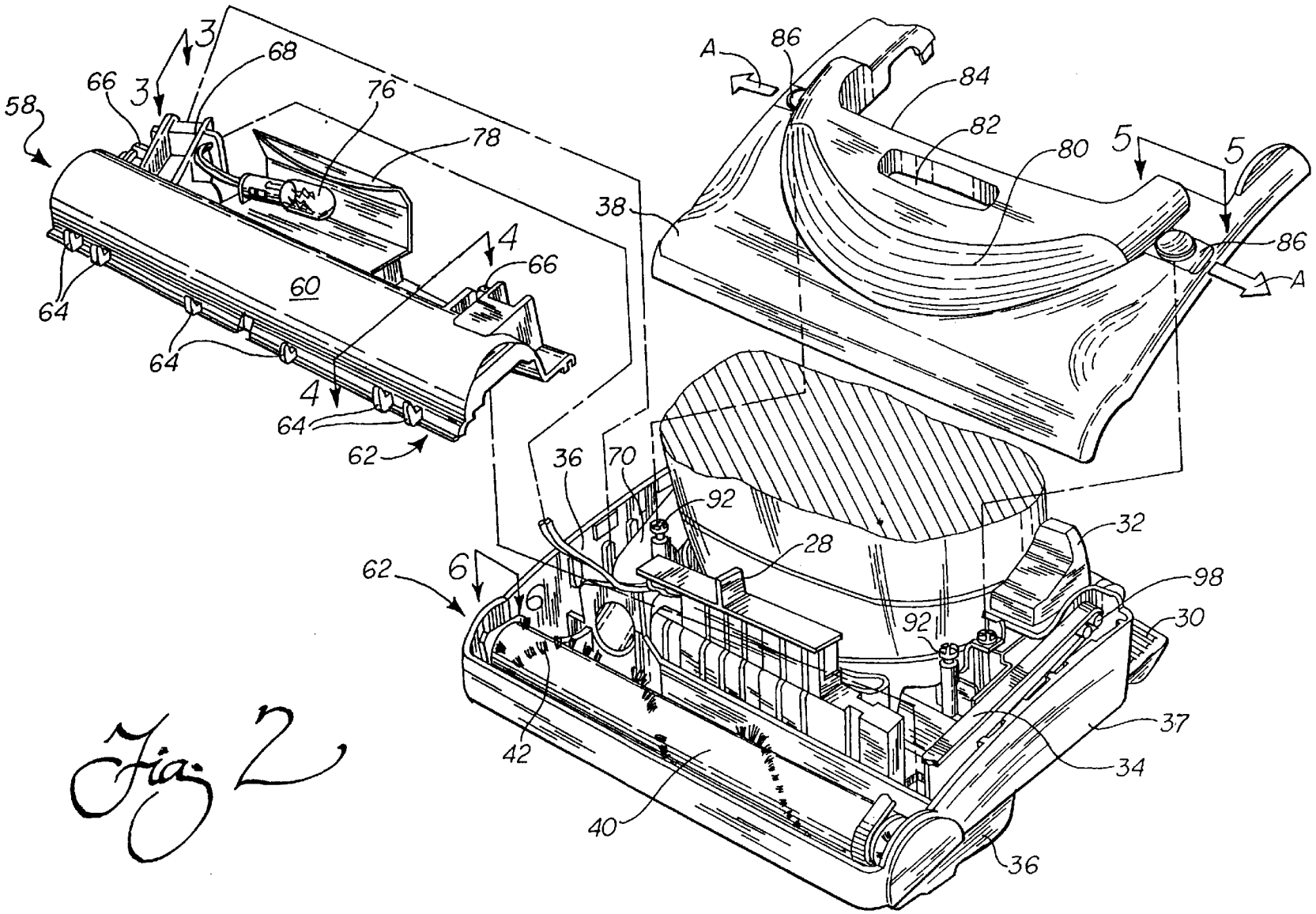
FIG. 2 is a detailed perspective view showing the releasable cover of the nozzle assembly and the inner agitator shield exploded to provide access to the agitator and agitator drive belt.

Reference will now be made in detail to the present preferred embodiment of the invention, an example of which is illustrated in the accompanying drawing.

DETAILED DESCRIPTION OF THE INVENTION

Reference is now made to FIG. 1 showing the upright vacuum cleaner 10 of the present invention. The upright vacuum cleaner 10 includes a nozzle assembly, generally designated by reference numeral 12 and a handle 14 pivotally connected to the nozzle assembly. As is well known in the art of upright vacuum cleaners, the handle 14 includes an internal cavity 13 which holds and receives a fan and motor assembly 15 and a dust bag 17 for collecting dirt and debris. The dust bag 17 may be accessed by removing the main door 16 through operation of the hand latch 18. A second smaller door 20 carried on the main door 16 includes a hand latch 22 that may be manipulated to allow access to a final filter cartridge (not shown).

The handle 14 includes a hand grip 24 that is grasped by the operator when vacuuming. An on/off switch 26 is conveniently located adjacent the hand grip 24. Of course, electrical power is supplied through a cord (not shown).

A pair of rear wheels 26 (only one shown) are mounted for relative rotation at the lower portion of the handle 14. These rear wheels 26 are provided to support the weight of the vacuum cleaner 10. The rear wheels 26 also provide a pivot point about which the nozzle assembly 12 pivots when the height of the nozzle assembly is adjusted by manipulation of the height adjustment switch 28.

As is known in the art, a foot latch 30 locks the handle 14 in the upright or storage position shown in FIG. 1 in order to allow storage and off-the-floor cleaning. When the foot latch 30 is released, the handle 14 may be pivoted relative to the nozzle assembly 12 in a manner well known in the art so as to allow an individual to manipulate and direct the vacuum cleaner 10 as desired through the hand grip 24. The actuator 32 is provided to allow one to disengage the drive motor from the agitator drive belt 34 (also see FIG. 2). In this way, it is possible to disengage the drive to the agitator 40 and provide "suction only" cleaning operation for bare floor cleaning or other appropriate applications. Operation of the actuator 32 is fully explained in co-pending patent application Ser. No. PCT/US96/20907 filed Dec. 31, 1996 and entitled "Shifter Mechanism For Vacuum Cleaner": the full disclosure of which is incorporated herein by reference.

Figure 7:
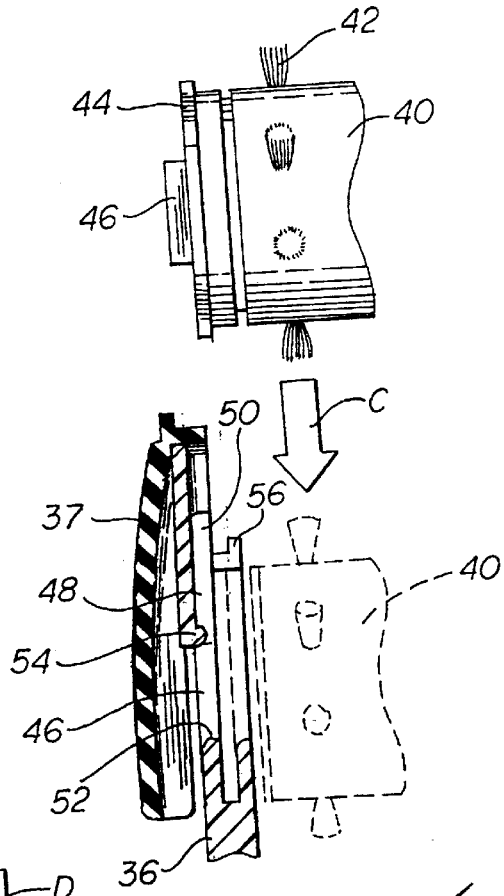
FIG. 7 is a detailed cross-sectional view of the structure shown in FIG. 6.
Figure 6:
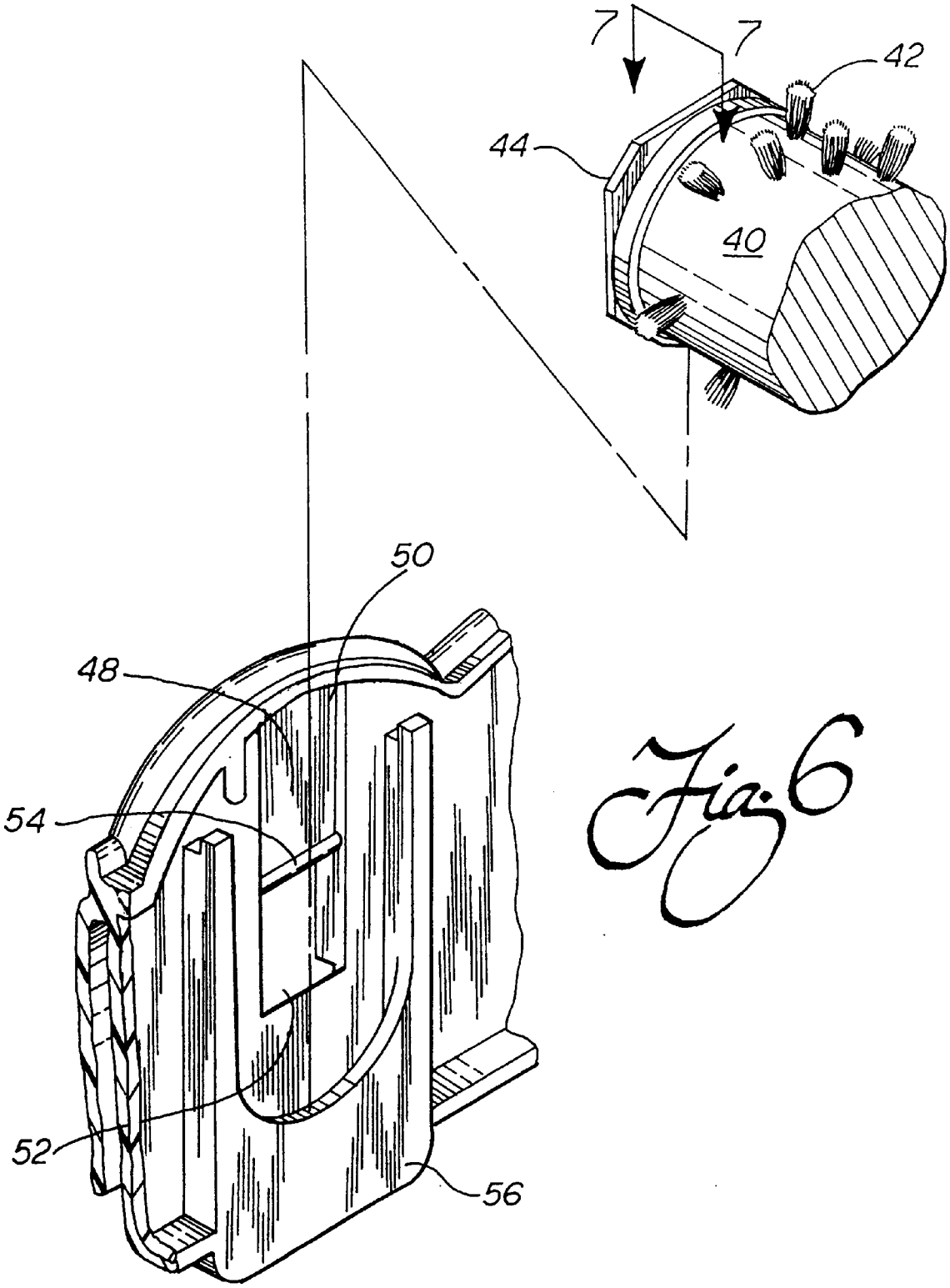
FIG. 6 is a detailed perspective view showing the structural arrangement for carrying the agitator in the base of the nozzle assembly.

As best shown with reference to FIG. 2, the nozzle assembly 12 includes a base 36 with a protective ribbon bumper 37 and a cooperating removable cover 38. As shown the base 36 carries the height adjustment switch 28 and its associated mechanism, the foot latch 30 and its associated mechanism and the actuator 32 and its associated mechanism. As shown, an agitator 40 including a series of bristles 42 is mounted for rotation relative to the base 36 of the nozzle assembly 12. More specifically, the agitator 40 rotates relative to a pair of bearing end caps 44, one end cap at each end of the agitator (see also FIG. 6 and 7). Each end cap 44 includes an outwardly projecting mounting lug 46. The base 36 includes a pair of opposed mounting channels 48. Each mounting channel 48 is closed at the lower or bottom end and open at a second opposite end 50 directed upwardly toward the cover 38.

When the agitator 40 is properly positioned in the base 36, the mounting lugs 46 are received in the mounting channels 48 adjacent the closed end 52 thereof. A detent 54 is provided in each mounting channel 48 adjacent the closed end 52 thereof. Together the side walls of the mounting channels 48, the closed ends 52 and the detents 54 function to engage the mounting lugs 46 at all four sides and hold the agitator 40 in position to allow relative rotation with respect to the base 36. The connection is further secured by a pair of mounting brackets 56 that are integrally molded into opposite sidewalls of the base 36 (note particularly FIG. 6). Each mounting bracket 56 engages and holds an end cap 44. As one mounting bracket 56 is provided to hold each end cap 44, the agitator 40 is securely held in position at all times of operation.

The base 36 of the nozzle assembly 12 also receives and holds an inner agitator shield 58. Inner agitator shield 58 includes an elongated, substantially arcuate body 60 which forms a concavity that cooperates with the base 36 to define the agitator chamber 62 in which the agitator 40 is mounted (see also FIG. 4).

The inner agitator shield 58 also includes a series of projecting lugs 64 and at least one and more preferably two resilient locking clips 66. As shown, the lugs 64 and locking clips 66 are provided along opposite sides of the agitator shield 58.

The agitator shield 58 also includes a discharge port 68. The discharge port 68 functions to direct dirt and debris laden air from the agitator chamber 62 into the suction conduit 70 carried in the base 76. The suction conduit 70 is in fluid communication with the fan and motor assembly 15 through connection of a hose (not shown) between the suction conduit 70 and the cavity 13 so as to allow delivery of dirt and debris to the dust bag 17 where it is captured for disposal.

Figure 3:
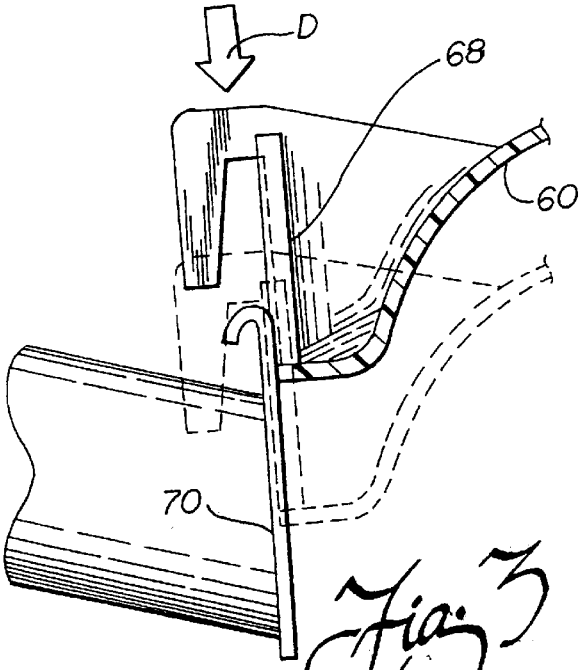
FIG. 3 is a detailed partially sectional view of the connection of the discharge port of the inner agitator shield with the suction conduit carried by the nozzle body.
Figure 4:
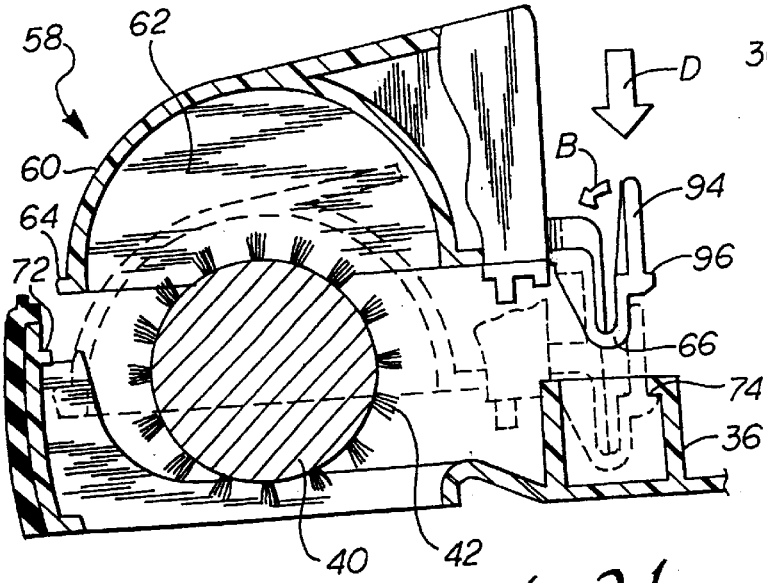
FIG. 4 is a detailed, partially sectional view showing the connection of the releasable locking clip of the inner agitator cover with the cooperating lip on the base of the nozzle assembly.

The inner agitator shield 58 is mounted in the base 36 by engaging the lugs 64 and clips 66, respectively, under cooperating shoulders 72 and lips 74 molded into the base 76 (see FIG. 4). When properly positioned the discharge port 68 of the agitator shield 58 aligns with and butts against the suction conduit 70 to provide an efficiently sealed air pathway (see FIG. 3).

As shown in FIG. 2, it should be appreciated that the agitator shield 58 also carries a headlight 76 and cooperating primary reflector 78. The cover 38 includes a window 80 through which light from the headlight 76 is directed. Cover 80 also includes a contoured aperture 82 that receives the height adjustment switch 38 and a cut out portion 84 that provides clearance for the handle 14.

The cover 38 also includes a pair of cooperating slide latches 86. Each slide latch 86 includes a projecting ear 88 carrying a notch 90 (see particularly, FIGS. 5*a* and 5*b*). When the cover 38 is secured to the base 36, the notch 90 engages a screw boss 92 carried on the base 36 with the head of the screw boss engaging the ear 88 and preventing direct lifting of the cover 38 from the base 36. With the cover 38 properly mounted on the base 36, the window 80 is provided in front of the headlight 76. The primary reflector 78 directs most of the light from the headlight 76 through the window 80. It should be appreciated, however, that the agitator shield 58 is molded from white plastic and functions as a secondary reflector to also direct light from the headlight 76 through the window 80 for best illumination of the work area during vacuuming.

Advantageously, the structure of the present invention allows one to quickly and conveniently service various component parts of the vacuum cleaner including the headlight 76, the agitator 40 and the agitator drive belt 34. More particularly, with the vacuum cleaner 10 in the storage position shown in FIG. 1, an individual simply slides the slide latches 86 outwardly in the direction of action arrow A shown in FIGS. 2 and 5*a*. This serves to release the notch 90 of ear 88 from the cooperating boss 92 at each side of the vacuum cleaner 10. This is followed by the removing of the cover 38 from the base 36 by simple lifting motion. The cut out portion 84 insures clearance of the cover around the handle 14 during the lifting operation. Removal of the cover 38 serves to expose both the headlight 76 for replacement if necessary as well as the inner agitator shield 58.

If it is desired to replace the agitator 40 or the agitator drive belt 34, the next step is the removing of the inner agitator shield 58. This is easily performed. Specifically, the individual manually engages the projecting fingers 94 of the two resilient clips 66 provided near each end of the agitator shield 58. The clips 66 are then depressed in the direction of action arrow B in FIG. 4 in order to release the mounting lug 96 of each of the clips from cooperating lips 74 of the base 36. Once the clips 66 are released, the agitator shield 58 is pivoted upwardly and forwardly to release the lugs 64 from the cooperating shoulders 72 of the base 36. The removal of the agitator shield 58 serves to expose the agitator 40. The agitator 40 is easily removed from the base 36 by pulling upwardly on the agitator 40 at each end while pushing outwardly on the sidewalls of the base 36. Specifically, the base 36 has sufficient resiliency to bow slightly under the pressure and thereby allow the mounting lugs 46 to clear the detents 54. After removing the agitator 40 from the base 36 of the nozzle assembly 12, the agitator may be repaired or replaced. Similarly, the agitator drive belt 34 may be removed from the agitator 40 and the drive pulley 98 and replaced.

Reassembly is quite simple. The agitator drive belt 34 is threaded over the drive pulley 98 and the agitator 40. The end caps 44 of the agitator 40 are then aligned with the mounting brackets 56 molded into the base 36. Simultaneously, the mounting lugs 46 are aligned with the mounting channels 48 formed in the base 36. The agitator 40 is then pressed downwardly (note action arrow C in FIG. 7) into the base 36 until the mounting lugs 46 snap past the detents 54 and the agitator 40 is effectively secured in its operating position.

Next the inner agitator shield 58 is resecured to the base 36. Specifically, the agitator shield 58 is aligned over the base 36 with the discharge port 68 engaging the suction conduit 70. Next the agitator shield 58 is pressed downwardly (note action arrow D in FIGS. 3 and 4) until the lugs 64 properly engage with the shoulders 72 and the clips 66 properly engage with the lip 74. The resiliency of the clips 66 allow the necessary clearance and then snap into position so that the mounting lugs 96 fully engage the lips 74 and provide a secure connection.

Next, the cover 38 is resecured to the base 36. Specifically, the cover 38 is aligned over the base 36 and pressed down on the base. Next, the slide latches 86 are manipulated in the direction of action arrow E (see FIG. 5*b*) so that the notches 90 on the ears 88 fully engage the bosses 92. This functions to secure the cover 38 in position. Advantageously, through this simple operation, maintenance of the headlight 76, agitator 40 and/or agitator drive belt 34 is easily completed without manipulating the machine from the storage position shown in FIG. 1.

In summary, numerous benefits result from employing the concepts of the present invention. Specifically, a vacuum cleaner of simple and inexpensive construction is provided. Advantageously, that vacuum cleaner provides a number of beneficial features including ease and convenient maintenance of the headlight 76, agitator 40 and agitator drive belt 34. Specifically, maintenance is completed while the vacuum cleaner is in the right side up position so that it is not necessary to manipulate or lift the vacuum cleaner during the performance of the desired service.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A vacuum cleaner comprising:

a housing including a handle and a nozzle assembly having a base and a removable upper cover;

a removable inner agitator shield held in said nozzle assembly substantially underlying said removable upper cover, said inner agitator shield including an elongated, substantially arcuate body and a releaseable latch;

an agitator mounted for rotation relative to said nozzle assembly in an agitator chamber; and a motor and fan assembly mounted to said housing for driving said agitator and providing suction.

2. The vacuum cleaner of claim 1, wherein said inner agitator shield includes at least one projecting lug and said base includes a cooperating lug engaging shoulder.

3. The vacuum cleaner of claim 3, wherein said releasable latch includes at least one resilient locking clip projecting in a direction substantially opposite said projecting lug.

4. The vacuum cleaner of claim 3, wherein said base includes a lip for engaging said locking clip.

5. The vacuum cleaner of claim 4, wherein said removable upper cover includes a slide latch and said base includes a mounting boss, said slide latch engaging said mounting boss when said removable upper cover is locked in position on said base.

6. The vacuum cleaner of claim 5, wherein said base includes a pair of opposed mounting channels each said mounting channel being closed at one end and opening upwardly at a second opposite end toward said removable upper cover.

7. The vacuum cleaner of claim 6, wherein said agitator includes a pair of end caps, one end cap being provided at each end of said agitator, each end cap also including a mounting lug, each mounting lug being received in one of said mounting channels when said agitator is carried in said base.

8. The vacuum cleaner of claim 1, wherein said inner agitator shield is molded as a single piece of resilient plastic.

9. A vacuum cleaner comprising:

a housing including a nozzle assembly and a handle;

an inner agitator shield held in said nozzle assembly;

an agitator mounted for rotation relative to said nozzle assembly in an agitator chamber;

a motor and fan assembly mounted to said housing for driving said agitator and providing suction; and a headlight mounted to said inner agitator shield wherein said inner agitator shield is white so as to act as a secondary light reflector.

10. The vacuum cleaner of claim 9, wherein said inner agitator shield includes an integral discharge part.

* * * * *

UNITED STATES PATENT AND TRADEMARK OFFICE

CERTIFICATE OF CORRECTION

PATENT NO. : 6,226,832 B1
DATED : May 8, 2001
INVENTOR(S) : Michael J. McCormick It is certified that error appears in the above-identified patent and that said Letters Patent is hereby corrected as shown below:

Column 7,
Line 4, "claim 3" should be "claim 2".

Column 8,
Line 19, "part" should be "port".

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*